US011174655B2

(12) United States Patent
Graindlair

(10) Patent No.: US 11,174,655 B2
(45) Date of Patent: Nov. 16, 2021

(54) SUNSHADE AND INCLINATION ADJUSTMENT MECHANISM FOR SAME

(71) Applicant: Steve Graindlair, Thetford Mines (CA)

(72) Inventor: Steve Graindlair, Thetford Mines (CA)

( * ) Notice: Subject to any disclaimer, the term of this patent is extended or adjusted under 35 U.S.C. 154(b) by 0 days.

(21) Appl. No.: 16/845,925

(22) Filed: Apr. 10, 2020

(65) Prior Publication Data

US 2020/0323321 A1 Oct. 15, 2020

Related U.S. Application Data

(60) Provisional application No. 62/832,581, filed on Apr. 11, 2019.

(30) Foreign Application Priority Data

Apr. 11, 2019 (CA) ..... 3040084

(51) Int. Cl.

| | |
|---|---|
| ***E04H 15/58*** | (2006.01) |
| ***A45B 17/00*** | (2006.01) |
| ***A45B 23/00*** | (2006.01) |
| ***E04H 15/52*** | (2006.01) |

(52) U.S. Cl.

CPC ..... *E04H 15/58* (2013.01); *A45B 17/00* (2013.01); *A45B 23/00* (2013.01); *E04H 15/52* (2013.01); *A45B 2023/0093* (2013.01)

(58) Field of Classification Search

CPC .. A45B 23/00; A45B 2023/0093; E04H 15/58
USPC ..... 135/124, 153, 155
See application file for complete search history.

(56) References Cited

U.S. PATENT DOCUMENTS

| | | | | | |
|---|---|---|---|---|---|
| 801,628 | A * | 10/1905 | Yenor | A45B 17/00 | 135/155 |
| 811,322 | A * | 1/1906 | Potlock | B63B 17/02 | 114/361 |
| 2,002,296 | A * | 5/1935 | Pope | A45B 17/00 | 135/155 |
| 2,045,840 | A * | 6/1936 | Davey | E04H 15/58 | 135/155 |
| 2,502,103 | A * | 3/1950 | Puls | A47C 29/003 | 135/155 |
| 2,550,311 | A * | 4/1951 | Tatoul | E04H 15/003 | 135/155 |

(Continued)

*Primary Examiner* — Noah Chandler Hawk
(74) *Attorney, Agent, or Firm* — Ralph E. Jocke; Walker & Jocke

(57) ABSTRACT

A sunshade and corresponding canopy inclination adjustment mechanism are provided. The sunshade includes a canopy support structure and the inclination adjustment mechanism. The support structure includes a pair of support rods having a length axially extending between a base and a top end, a pair of coupling assemblies respectively connected to the top end of one of the support rods, and a canopy frame including a frame member having opposed end portions pivotally connected to a corresponding one of the coupling assemblies, the canopy being supported at least partially by the canopy frame. The inclination adjustment mechanism is adapted to adjust the angle of the canopy and includes an actuator, attached to the support structure, and including a rod engagement member operatively connected to the frame member, whereby operation of the actuator engages the frame member in pivoting via the rod engagement member, thereby pivoting the canopy frame.

17 Claims, 10 Drawing Sheets

(56) References Cited

U.S. PATENT DOCUMENTS

| | | | | | |
|---|---|---|---|---|---|
| 2,615,459 | A * | 10/1952 | Adams | A45B 3/00 | 135/153 |
| 5,331,992 | A * | 7/1994 | Gremont | E04H 15/58 | 135/119 |
| 9,155,364 | B2 * | 10/2015 | Jason | A45B 17/00 | |
| 10,477,930 | B2 * | 11/2019 | Kuypers | A45B 25/02 | |
| 2004/0103935 | A1 * | 6/2004 | Porter | E04H 15/46 | 135/124 |
| 2009/0301534 | A1 * | 12/2009 | Bettega | E04H 15/58 | 135/96 |
| 2016/0177575 | A1 * | 6/2016 | Ivic | E06B 9/386 | 52/302.1 |

* cited by examiner

SUNSHADE AND INCLINATION ADJUSTMENT MECHANISM FOR SAME

CROSS-REFERENCE TO RELATED APPLICATIONS

This application claims priority under 35 USC § 119 of U.S. Provisional Application No. 62/832,581, filed Apr. 11, 2019, entitled "SUNSHADE AND INCLINATION ADJUSTMENT MECHANISM FOR SAME", and of CA Application No. 3.040.084, filed Apr. 11, 2019, entitled "SUNSHADE AND INCLINATION ADJUSTMENT MECHANISM FOR SAME" the entirety of which are hereby incorporated by reference.

TECHNICAL FIELD

The technical field generally relates to sunshades, and n ore particularly to freestanding sunshades having an adjustable canopy.

BACKGROUND

A sunshade is a well-known product used during generally sunny days to create shaded areas using a canopy. The canopy is typically upheld by one or more support interconnected rods configured to be manipulated and constantly adjusted according to the position of the sun. An example of such a sunshade is described in US application No. 2017/0086543. Other types of sunshade products include larger canopies requiring additional support due to their size and/or weight. These types of larger sunshades are generally freestanding structures which are not meant to be moved around, therefore limiting the adjustment capabilities of the sunshade.

There is thus a need for an improved sunshade, and corresponding components, which can overcome at least some of the prior art deficiencies, and facilitate adjustment of the canopy.

SUMMARY

According to a first aspect, a sunshade is provided. The sunshade includes a canopy support structure for supporting a canopy having at least two support rods, each one of the support rods having a length axially extending between a base and a top end. The canopy support structure further including coupling assemblies, each one of the coupling assemblies being connected to the top end of a respective one of the support rods. Furthermore, the canopy support structure includes a canopy frame comprising a frame member having opposed end portions pivotally connected to a corresponding one of the coupling assemblies, the canopy being supported at least partially by the canopy frame. The sunshade also includes an inclination adjustment mechanism for adjusting an angle of the canopy. The inclination adjustment mechanism includes a frame actuator, and a rod engagement member operatively connecting the frame actuator to the frame member, whereby operation of the frame actuator pivots the frame member via the rod engagement member, thereby tilting the canopy frame.

According to a possible embodiment, the end portions of the frame member are axially aligned with one another.

According to a possible embodiment, each one of the coupling assemblies includes a coupling housing fixedly connected to the top end of the respective one of the support rods, the coupling housing having a passage defined therethrough for receiving the corresponding one of the end portions of the frame member.

According to a possible embodiment, each one of the end portions is axially aligned with the passage of the corresponding one of the coupling housings.

According to a possible embodiment, each one of the coupling housings includes a clamp selectively adjustable to vary a surface area of the passage and facilitate engagement of the corresponding one of the end portions within the passage.

According to a possible embodiment, each one of the coupling assemblies further includes a bushing mounted to the corresponding one of the end portions, the bushings being shaped and configured to allow rotation of the corresponding one of the end portions within the passage and at least partially prevent radial movement of the end portions when engaged within the passages.

According to a possible embodiment, each one of the end portions of the frame member includes a proximal protrusion extending radially and outwardly from a proximal section thereof for abutting against a first lateral side of the coupling housing upon engagement of the end portion within the passage of the coupling housing.

According to a possible embodiment, each one of the end portions further includes a distal protrusion removably connectable to a distal section thereof, the distal protrusion abutting against a second lateral side of the coupling housing when the end portion is engaged within the passage and the distal protrusion is secured to the distal section of the end portion, thereby positioning the coupling housing between the proximal and distal protrusions.

According to a possible embodiment, the frame actuator of the inclination adjustment mechanism includes a motor operatively connected to the rod engagement member and mounted to the support structure.

According to a possible embodiment, the inclination adjustment mechanism further includes a controller operatively connected to the motor to control same, the controller being remotely controllable.

According to a possible embodiment, one of the end portions of the frame member includes an end surface having a recess defined therein, and wherein the rod engagement member is insertable into the recess with relative rotation between the rod engagement member and the one of the end portions being substantially prevented when engaged together, thereby engaging the frame member in rotation upon operation of the frame actuator.

According to a possible embodiment, the rod engagement member includes at least one outwardly protruding and peripherally positioned tooth and the recess defined in the distal end of the one of the end portions includes at least one complementary indentation, with the at least one tooth being insertable into the at least one complementary indentation to substantially prevent relative rotation between the rod engagement member and the one of the end portions.

According to a second aspect, an inclination adjustment mechanism for adjusting an angle of a canopy supported by a canopy support structure having a canopy frame is provided. The inclination adjustment mechanism including a frame actuator, and a rod engagement member operatively connecting the frame actuator to a canopy frame member, whereby operation of the frame actuator engages the canopy frame member in rotation via the rod engagement member, thereby tilting the canopy.

According to a third aspect, a sunshade is provided. The sunshade includes a canopy support structure for supporting a canopy above a ground surface. The canopy support structure includes coupling assembly supports, coupling assemblies, each one being mounted to a respective one of the coupling assembly supports, and a canopy frame comprising a frame member having opposed end portions pivotally connected to a corresponding one of the coupling assemblies, the canopy being supported at least partially by the canopy frame. The sunshade further includes an inclination adjustment mechanism adapted to adjust an angle of the canopy, the inclination adjustment mechanism including a rod engagement member operatively connected to the frame member, whereby rotation of the engagement member engages the frame member in rotation.

According to a possible embodiment, the inclination adjustment mechanism further includes a frame actuator operatively connected to the rod engagement member whereby actuation of the frame actuator engages the rod engagement member and the frame member in rotation simultaneously.

According to a possible embodiment, the frame actuator of the inclination adjustment mechanism includes a crank engageable with the rod engagement member to engage same in rotation.

According to a possible embodiment, the frame actuator of the inclination adjustment mechanism includes a motor mounted to one of the support rods and operatively connected to the rod engagement member to engage same in rotation.

According to a possible embodiment, the end portions of the frame member are axially aligned with one another.

According to a possible embodiment, each one of the coupling assemblies includes a coupling housing fixedly connected to the respective one of the coupling assembly supports, the coupling housing having a passage defined therethrough for receiving the corresponding one of the end portions of the frame member.

According to a possible embodiment, each one of the end portions is axially aligned with the passage of the corresponding one of the coupling housings.

According to a possible embodiment, each one of the coupling housings includes a clamp selectively adjustable to vary a surface area of the passage and facilitate engagement of the corresponding one of the end portions within the passage.

According to a possible embodiment, each one of the coupling assemblies further includes a bushing mounted to the corresponding one of the end portions, the bushings being shaped and configured to allow rotation of the corresponding one of the end portions within the passage and at least partially prevent radial movement of the end portions when engaged within the passages.

According to a possible embodiment, each one of the end portions of the frame member includes a proximal protrusion extending radially and outwardly from a proximal section thereof for abutting against a first lateral side of the coupling housing upon engagement of the end portion within the passage of the coupling housing.

According to a possible embodiment, each one of the end portions further includes a distal protrusion removably connectable to a distal section thereof, the distal protrusion abutting against a second lateral side of the coupling housing when the end portion is engaged within the passage and the distal protrusion is secured to the distal section of the end portion, thereby positioning the coupling housing between the proximal and distal protrusions.

According to a possible embodiment, one of the end portions of the frame member includes an end surface having a recess defined therein, and wherein the rod engagement member is insertable into the recess with relative rotation between the rod engagement member and the one of the end portions being substantially prevented when engaged together, thereby engaging the frame member in rotation upon operation of the frame actuator.

According to a possible embodiment, the rod engagement member includes at least one outwardly protruding and peripherally positioned tooth and the recess defined in the distal end of the one of the end portions includes at least one complementary indentation, with the at least one tooth being insertable into the at least one complementary indentation to substantially prevent relative rotation between the rod engagement member and the one of the end portions.

DETAILED DESCRIPTION

In the following description, the same numerical references refer to similar elements. In addition, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the various exemplary embodiments described herein may be used in relation with a sunshade, it is understood that it may be used with other types of products and/or for other purposes. For this reason, the expression "sunshade" as used herein should not be taken as to limit the scope of the present disclosure as being used with products relating to sun protection in particular.

In addition, although the optional configurations as illustrated in the accompanying drawings comprise various components and although the optional configurations of the sunshade as shown may consist of certain configurations as explained and illustrated herein, not all of these components and configurations are essential and thus should not be taken in their restrictive sense, i.e. should not be taken as to limit the scope of the present disclosure. It is to be understood that other suitable components and cooperations thereinbetween, as well as other suitable configurations may be used for the sunshade, and corresponding parts, as briefly explained, and as can be easily inferred herefrom, without departing from the scope of the disclosure.

As will be explained below in relation to various embodiments, a sunshade and sunshade inclination adjustment mechanism for adjusting a canopy of said sunshade are provided. More specifically, the sunshade includes a support structure shaped and configured to support the canopy of the sunshade, while the inclination adjustment mechanism is configured to adjust the angular position of the canopy via rotation of a segment of the support structure. In an embodiment, the inclination adjustment mechanism includes a motor operatively connected to the support structure such that operation of the motor effectively pivots the canopy.

Figure 1:
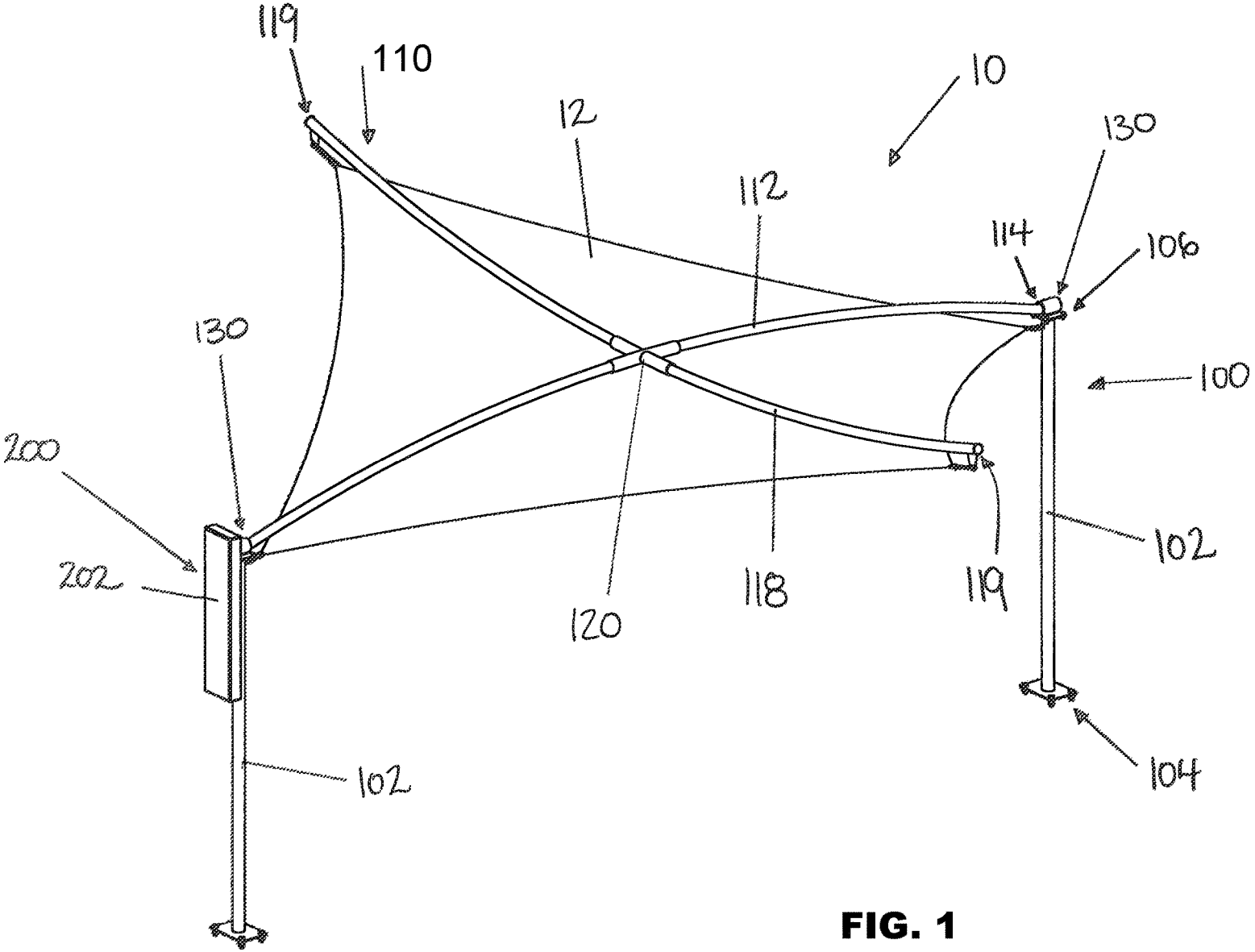
FIG. 1 is a perspective view of a sunshade according to an embodiment.

Referring to FIG. 1, a sunshade 10 is shown in accordance with an embodiment. The sunshade 10 includes a support structure 100 for supporting a canopy 12 above a ground surface, and further includes an inclination adjustment mechanism 200 mounted to the support structure 100 and configured to adjust an inclination of the canopy in a manner that will be described further below. In this embodiment, the support structure 100 includes a pair of support rods 102 respectively having a length extending between a base 104 and a top end 106. As seen in FIG. 1, the support rods 102 can be substantially straight and securable to the ground surface via mechanical fasteners extending through the base 104 for example. Therefore, it should be understood that the support structure 100 can be a freestanding support structure, although it is appreciated that other configurations are possible.

In this embodiment, the support structure 100 includes a canopy frame 110 connected to and extending between the support rods 102. More specifically, the support structure 100 can include a pair of coupling assemblies 130 provided proximate the top ends 106 of the support rods 102 for coupling the canopy frame 110 to the support rods 102. In some embodiments, the canopy frame 110 includes at least one frame member 112 extending between the support rods 102 and having opposite end portions 114 adapted to be connected to a corresponding one of the coupling assemblies 130. In this embodiment, the end portions 114 are pivotally connected to the coupling assemblies 130 in order to allow pivoting/tilting of the canopy frame 110, and therefore pivoting/tilting of the canopy 12 itself.

Still referring to FIG. 1, the adjustment mechanism 200 can be configured to adjust the inclination of the canopy 12, and more specifically the angular position of the canopy 12 via pivoting tilting of the canopy frame 110. In this embodiment, the inclination adjustment mechanism 200 is attached to one of the support rods 102 proximate the top end 106 thereof, although it is appreciated other configurations are possible. As will be described further below, the inclination adjustment mechanism 200 can include a motor 202 operatively connected to the frame member 112 such that operation of the motor 202 engages the frame member 112 in rotation, effectively adjusting the angle of the canopy 12.

Figure 2A:
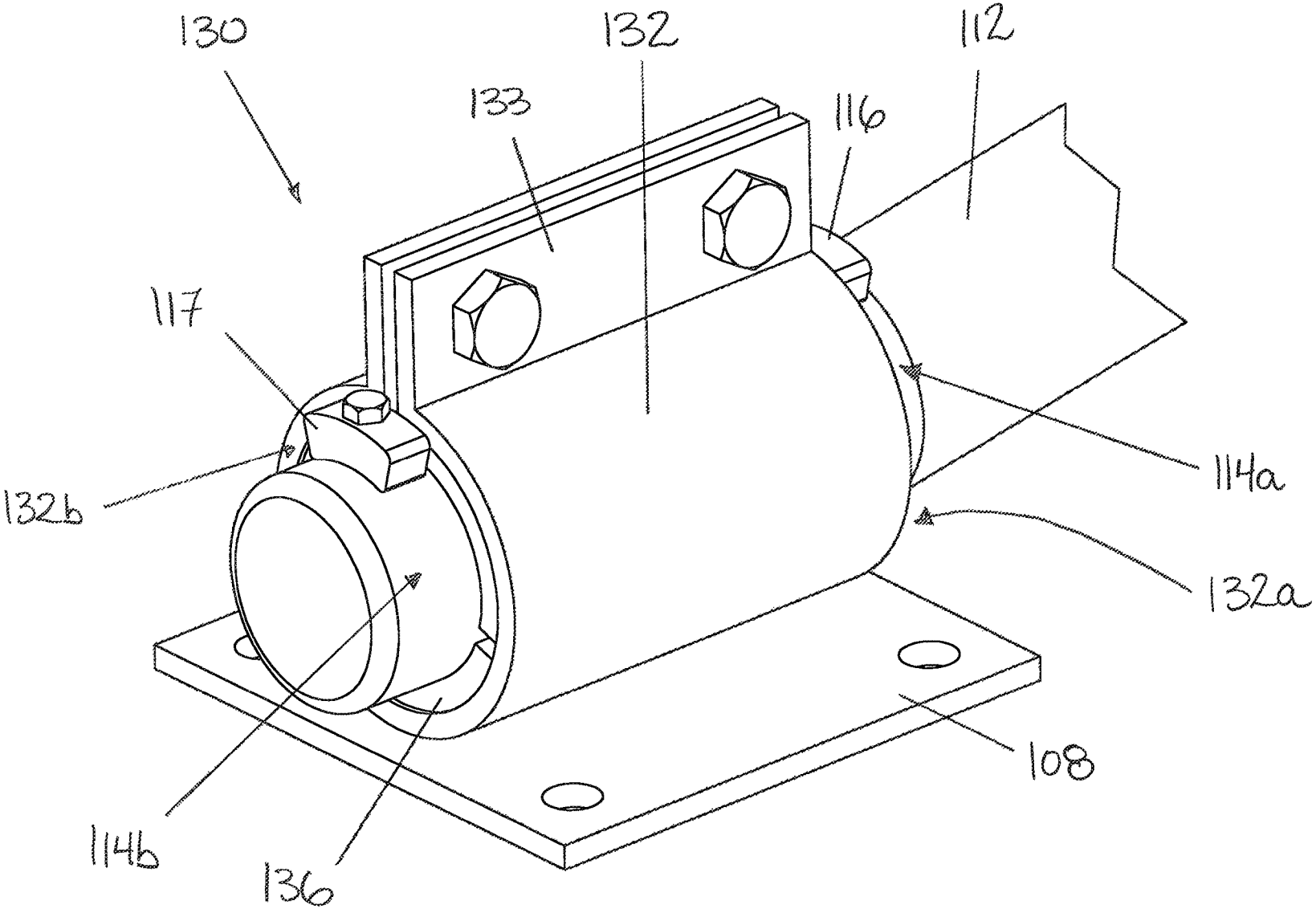
FIG. 2A is a perspective view of a coupling assembly according to an embodiment, showing a frame member being coupled to the coupling assembly.
Figure 2B:
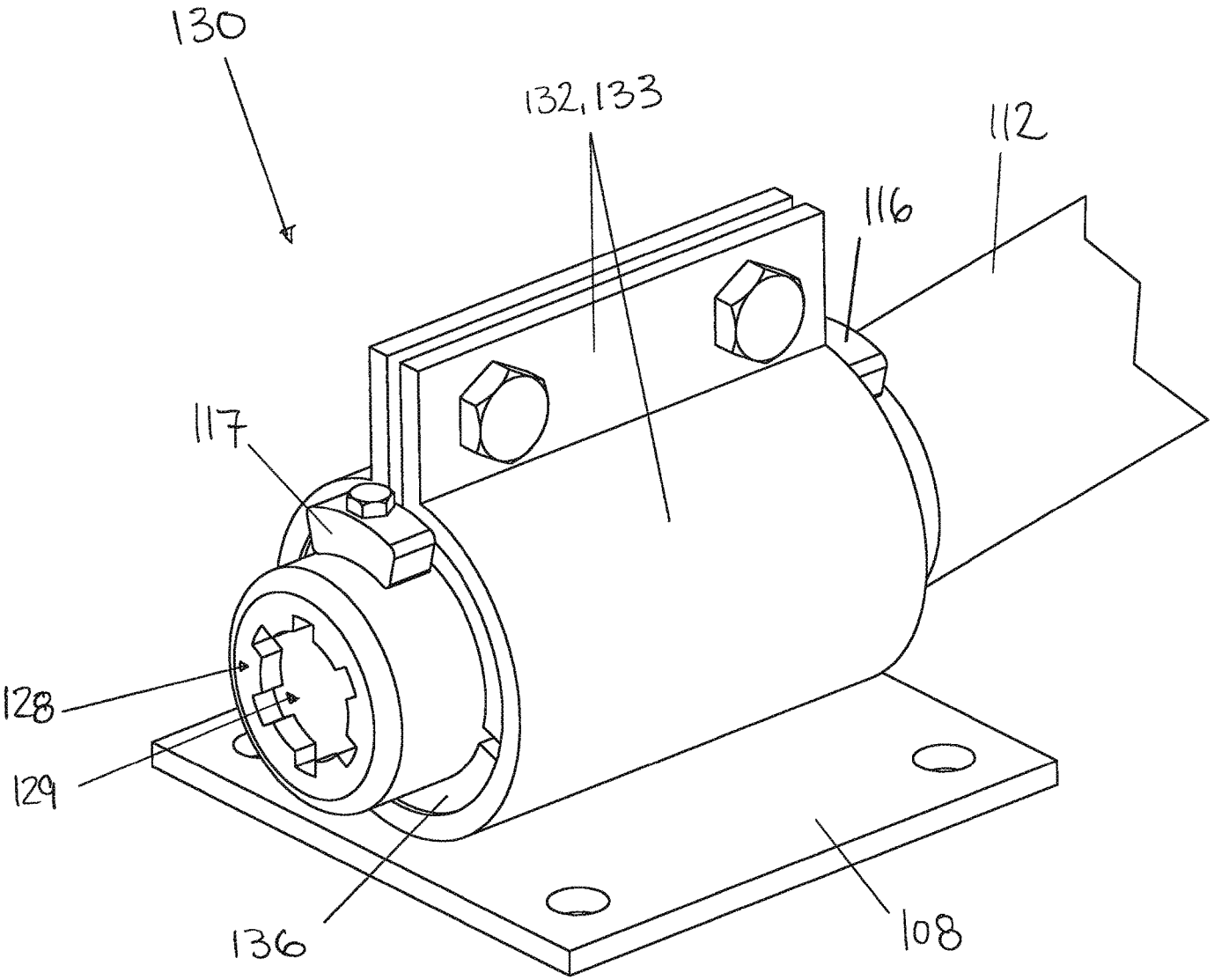
FIG. 2B is a perspective view of a coupling assembly similar to the one of FIG. 2A, showing a recess defined in a distal surface of the frame member according to an embodiment.
Figure 3:
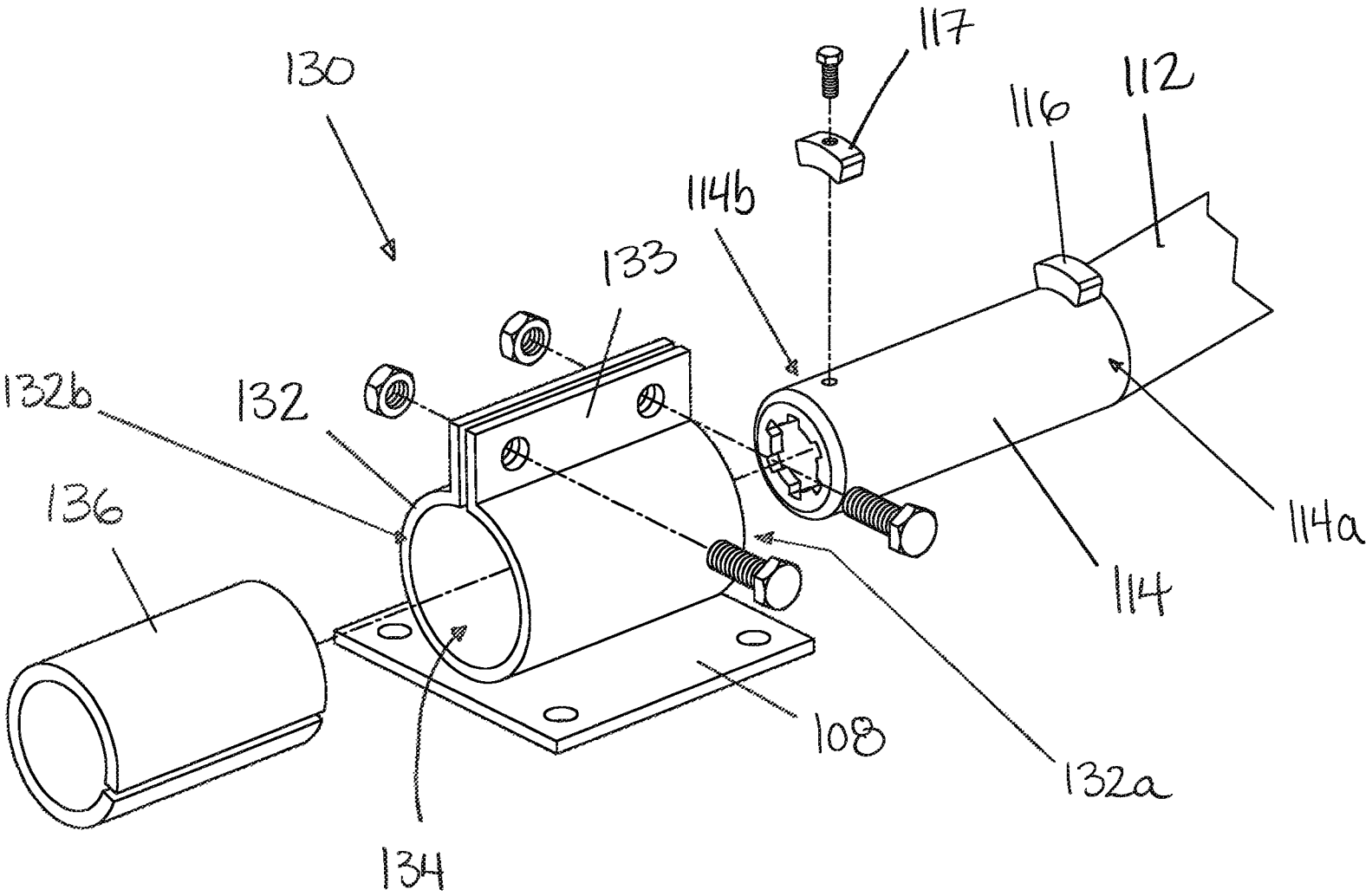
FIG. 3 is an exploded perspective view of the coupling assembly shown in FIG. 2B, showing a bushing mountable to an end portion of the frame member, according to an embodiment.

With reference to FIGS. 2A to 3, in addition to FIG. 1, exemplary embodiments of a coupling assembly 130 is shown. In some embodiments, the coupling assembly 130 can be fixedly connected to the top end 106 of the corresponding support rod 102. For example, the top end 106 of the support rod 102 can be provided with a coupling assembly support, such as a top plate 108, on which the coupling assembly 130 can be secured. For example, the coupling assembly 130 can include a coupling housing 132 securable to the top plate 108 via any suitable means, such as welding or mechanical fasteners for example. The coupling housing 132 can be shaped and configured to receive a corresponding one of the end portions 114 of the frame member 112. More specifically, the coupling housing 132 is substantially cylindrical in shape and defines a channel, or passage 134 (FIG. 3) therethrough shaped and sized to receive the aforementioned end portion 114.

It is appreciated that, in an alternative embodiment (not shown), the support structure 100 of the sunshade 10 can be exempt or include only one support rod 102. For instance, the coupling assembly support can be mounted to any other suitable support structure such as a wall, a tree, a column, etc. For instance, and without being limitative, the coupling assembly support can include a bracket secured to the support structure (for instance, bolted into a wall). The coupling assembly 130 can then be mounted to and supported by the coupling assembly support, embodied by a bracket.

In an embodiment, the end portion 114 is rotatably connected to or engaged with the coupling housing 132 for allowing rotation of the canopy frame 110. In this embodiment, the coupling assembly 130 includes a sleeve bearing, or bushing 136, slidably mounted to the end portion 114 prior to engaging the passage 134. More particularly, the bushing 136 being substantially cylindrical in shape defines a bushing channel into which the end portion 114 of the frame member 112 is inserted. As such, the end portion 114 (provided with bushing 136) can fit snugly within the passage 134, and is allowed to rotate therein. It is appreciated that securing the frame member 112 and bushing 136 via the coupling housing 132 can at least partially prevent radial movement of the end portion 114 within the passage 134. Therefore, the frame member 112, or at least the end portion 114 thereof, remains aligned (e.g., concentric) with the passage 134 during use of the sunshade 10.

In the present embodiment, the coupling housing 132 can be selectively adjusted to facilitate insertion, and subsequent securement, of the end portion 114 and bushing 136 within the passage 134. As seen in FIGS. 2A to 3, the coupling housing 132 can include a clamp 133 operable to adjust the cross-sectional area of the passage 134. It should be understood that loosening/unfastening/opening the clamp 133 increases the cross-sectional area of the passage 134, therefore facilitating insertion of the end portion 114 and bushing 136 through said passage 134. On the other hand, tightening/fastening/closing the clamp 133 effectively reduces the cross-sectional area of the passage 134 and can thus secure the bushing 136 and end portion 114 therein.

Still referring to FIGS. 2A to 3, the end portion 114 can include a proximal protrusion 116 radially and outwardly extending therefrom for abutting against a first lateral side 132*a* of the coupling housing 132 and blocking axial movement of the end portion 114 through the passage 134. The proximal protrusion 116 can extend at least partially around a periphery of the end portion 114, as seen in FIG. 3, although it is appreciated that the proximal protrusion 116 can extend along any suitable portion of said periphery, such as completely around for example. Furthermore, the proximal protrusion 116 is illustratively provided at a proximal section 114*a* of the end portion 114 such that it abuts against the first lateral side 132*a* once the end portion 114 has extended through the passage 134.

The end portion 114 can further include a distal protrusion 117 removably connectable to the end potion 114 and adapted to abut against a second lateral side 132*b* of the coupling housing 132, opposite the first lateral side 132*a*. It is appreciated that the distal protrusion 117 is configured to be connected to a distal section 114*b* of the end portion 114 in order to effectively secure the coupling housing 132 between the proximal and distal protrusions 116, 117. It is further appreciated that, in order to secure the coupling housing 132 between the protrusions, the distal protrusion 117 is connected to the distal section 114*b* once the end portion 114 has extended through the passage 134. It should thus be understood that when the proximal and distal protrusions 116, 117 are positioned on either side of the coupling housing 132, axial movement of the end portion 114 is prevented, or at least partially limited. In other words, the abutment of the protrusions 116, 117 with the corresponding lateral side 132*a*, 132*b* prevents, or at least limits, axial movement of the end portion 114 in either direction through the passage 134.

Referring back to FIG. 1, the frame member 112 can be a first frame member 112, and the canopy frame 110 can include a second frame member 118 to further support the canopy 12. In this embodiment, the second frame member 118 is connected to the first frame member 112 in a manner that will be further described below. In some embodiments, the first and second frame members 112, 118 can be two distinct members connected to one another using any suitable fastening means/method such as mechanical fasteners, adhesive(s), welding, or simply via a string tying both the frame members together, for example. Alternatively, it is appreciated that the first and second frame members 112, 118 can be a single one-piece unit (e.g., moulded, welded).

Figure 7A:
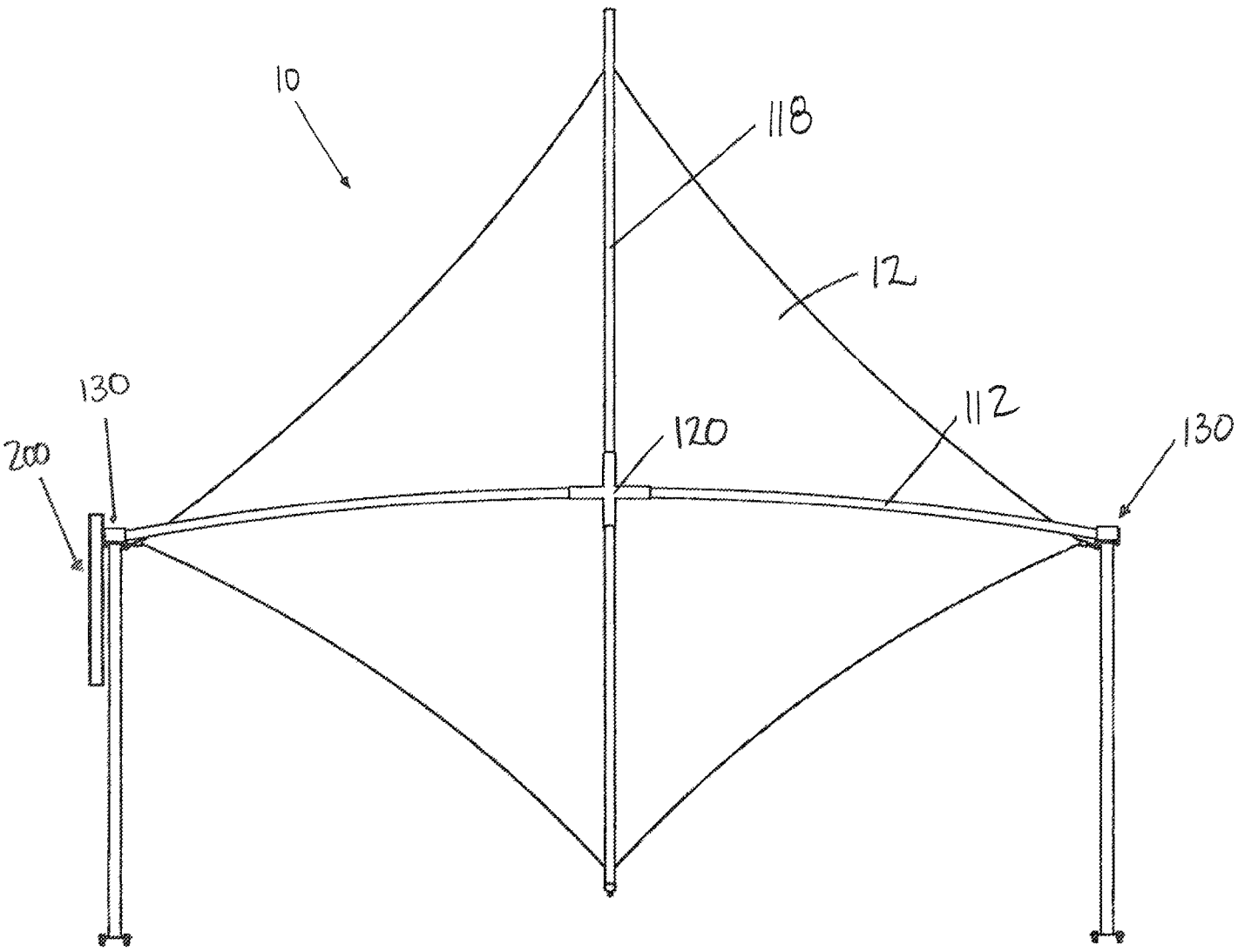
FIG. 7A to 7C are front elevation views of the sunshade shown in FIG. 1, showing the position of the canopy corresponding to the angular positions of the frame member shown in FIGS. 6A to 6C respectively.
Figure 7B:
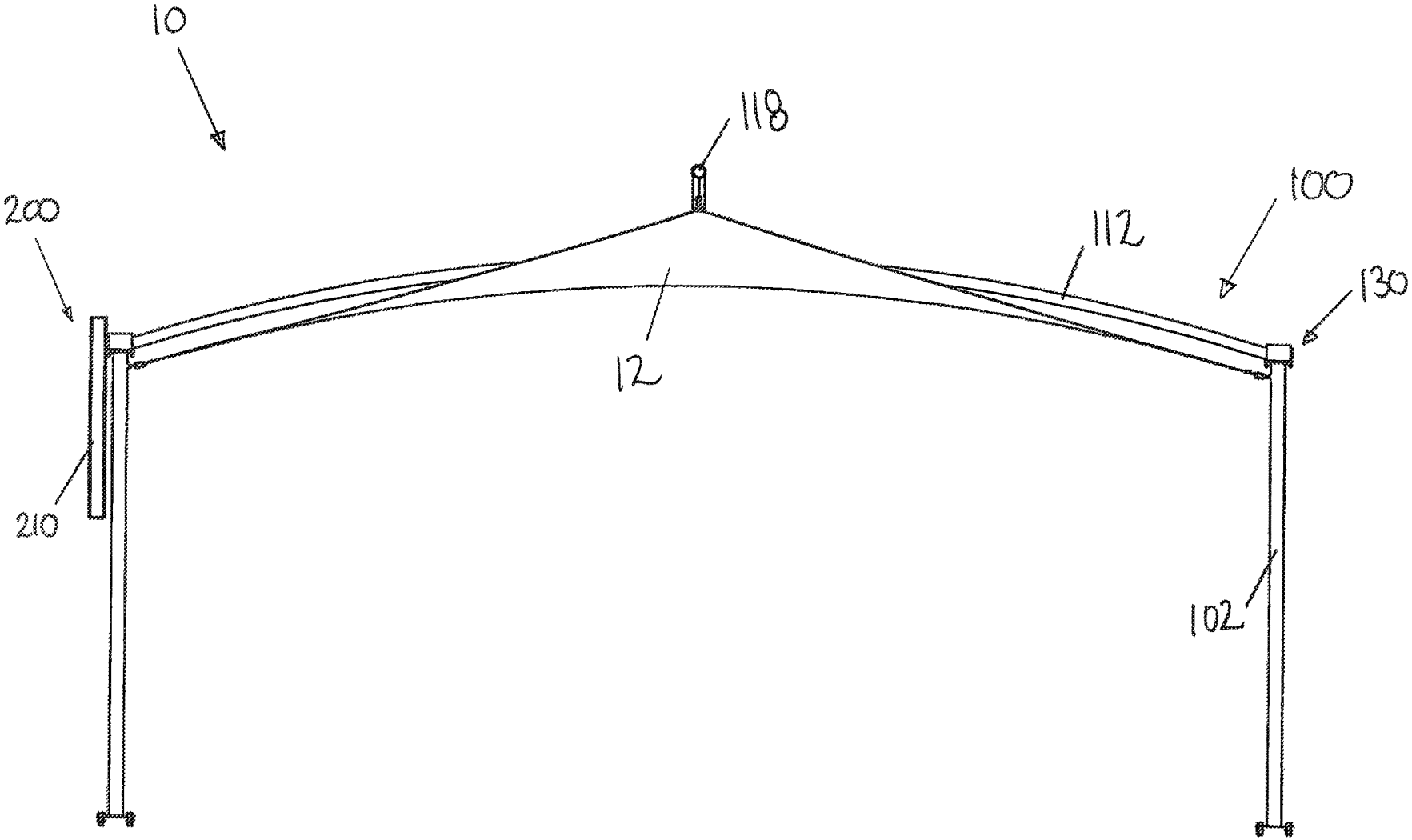
Figure 7C:
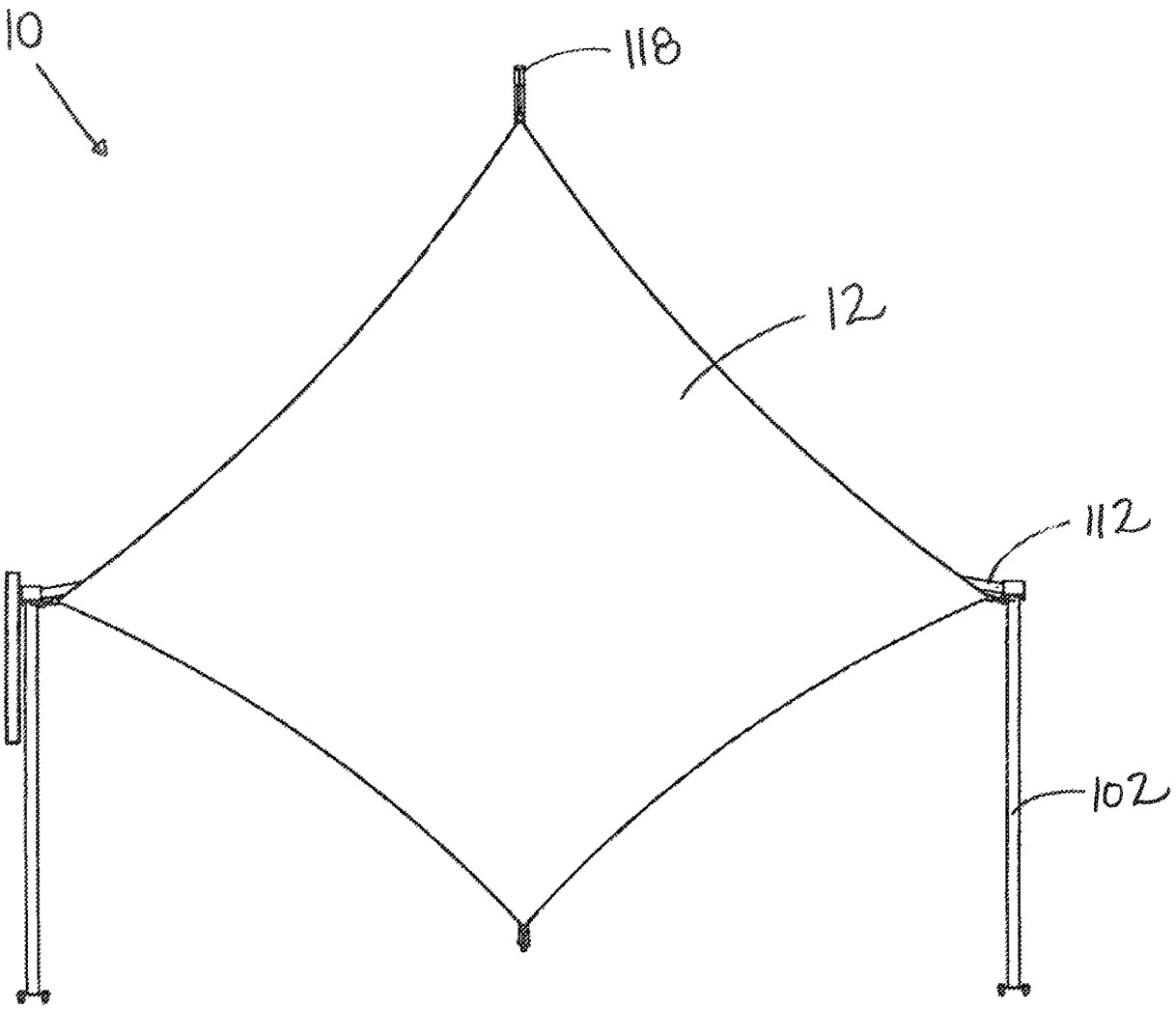

In some embodiments, the frame members 112, 118 can be curved along at least a portion of their respective lengths. For example, and as seen in FIGS. 1 and 7B, the first frame member 112 can be downwardly curved while the second frame member 118 can be upwardly curved. This can be useful to provide an eccentric/curved shape to the supported canopy 12, which can be more appealing to the eye when compared to a relatively flat canopy 12. In some embodiments, the frame members 112, 118 can be curved along their entire lengths, although other configurations are possible. For example, the first frame member 112 can be curved along a length extending between the end portions 114, with the end portions 114 being axially aligned with each other, and with the passages 134 of the coupling assemblies 130.

In the present embodiment, the canopy frame 110 includes a central hub 120 configured to connect and position the first and second frame members 112, 118 relative to one another. More specifically, the central hub 120 can include one or more sleeves shaped and configured for receiving the first and/or second frame members 112, 118. It should thus be understood that the central hub 120 is positioned at an intersection between the first and second frame members 112, 118. In this embodiment, the central hub 120 is positioned proximate a central portion of the canopy frame 110 (e.g., halfway along the first and second frame members 112, 118), although it is appreciated that other configurations are possible.

Figure 4:
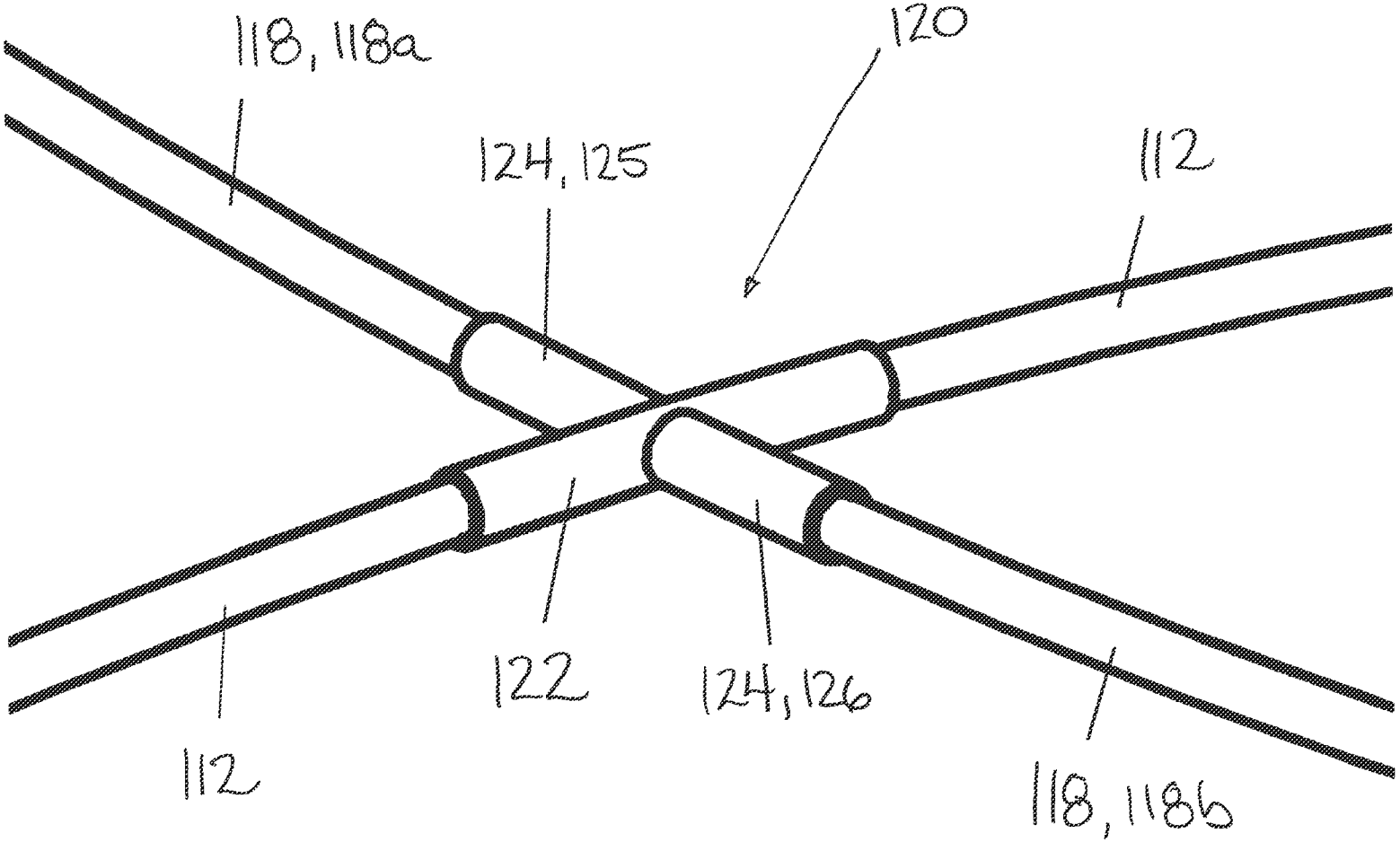
FIG. 4 is an enlarged view of a central hub according to an embodiment, showing frame members connected to and extending from said central hub.

Referring more specifically to FIG. 4, the central hub 120 can include a main sleeve 122 for receiving the first frame member 112, and a secondary sleeve 124 for receiving the second frame member 118. In this embodiment, the secondary sleeve 124 is substantially perpendicular to the main sleeve 122, thereby positioning the second frame member 118 substantially perpendicularly with respect to the first frame member 112. However, it is appreciated that other configurations are possible, and that the sleeves 122, 124 of the central hub 120 can define any suitable angle therebetween. Furthermore, in this embodiment, the main sleeve 122 and the secondary sleeve 124 illustratively intersect one another such that the secondary sleeve 124 is divided in a first secondary sleeve 125 and a second secondary sleeve 126. It should thus be understood that, once the first frame member 112 extends through the main sleeve 122, the second frame member 118 cannot extend through each of the secondary sleeves 125, 126 (due to the presence of the first frame member 112 therebetween). As such, the second frame member 118 can include a first segment 118*a* connected to and extending outwardly from the first secondary sleeve 125, and a second segment 118*b* connected to and extending outwardly from the second secondary sleeve 126. Alternatively, it is appreciated that the main sleeve 122 and first frame member 112 can similarly be separated into two opposite segments instead of, or alongside the second frame member 118 and secondary sleeve 124.

Referring broadly to FIGS. 1 to 5, the support structure 100 as described above is configured to support the canopy 12 in an elevated position with respect to a ground surface. In some embodiments, the canopy 12 can be connected to the first frame member 112, the second frame member 118, or either of the support rods 102, among others. In the present embodiment, and as seen in FIG. 1, the canopy 12 has a substantially square or rectangular shape such that it comprises four corners (i.e., two pairs of opposite corners). A first pair of corners is at least partially supported by the second frame member 118 via connection means provided proximate opposite end portions 119 thereof. The second pair of corners is illustratively connected to each support rod 102 proximate their respective top ends 106 via similar connection means such that each corner of the canopy 12 is supported by the support structure 100. Optionally, the canopy 12 can be further connected to the central hub 120, although it is appreciated that other configurations are possible. In some embodiments, the connection means can include a carabiner connection 150 (FIG. 5), with one or more hooks 152 provided on the support structure 100 (e.g., on support rods 102 and/or frame members 112, 118), adjacent to the top end 106, and a corresponding number of carabiners 154 connected to the canopy 12. However, it is appreciated that any other suitable connection means/method are possible for connecting the canopy 12 to the support structure 100.

Figure 5:
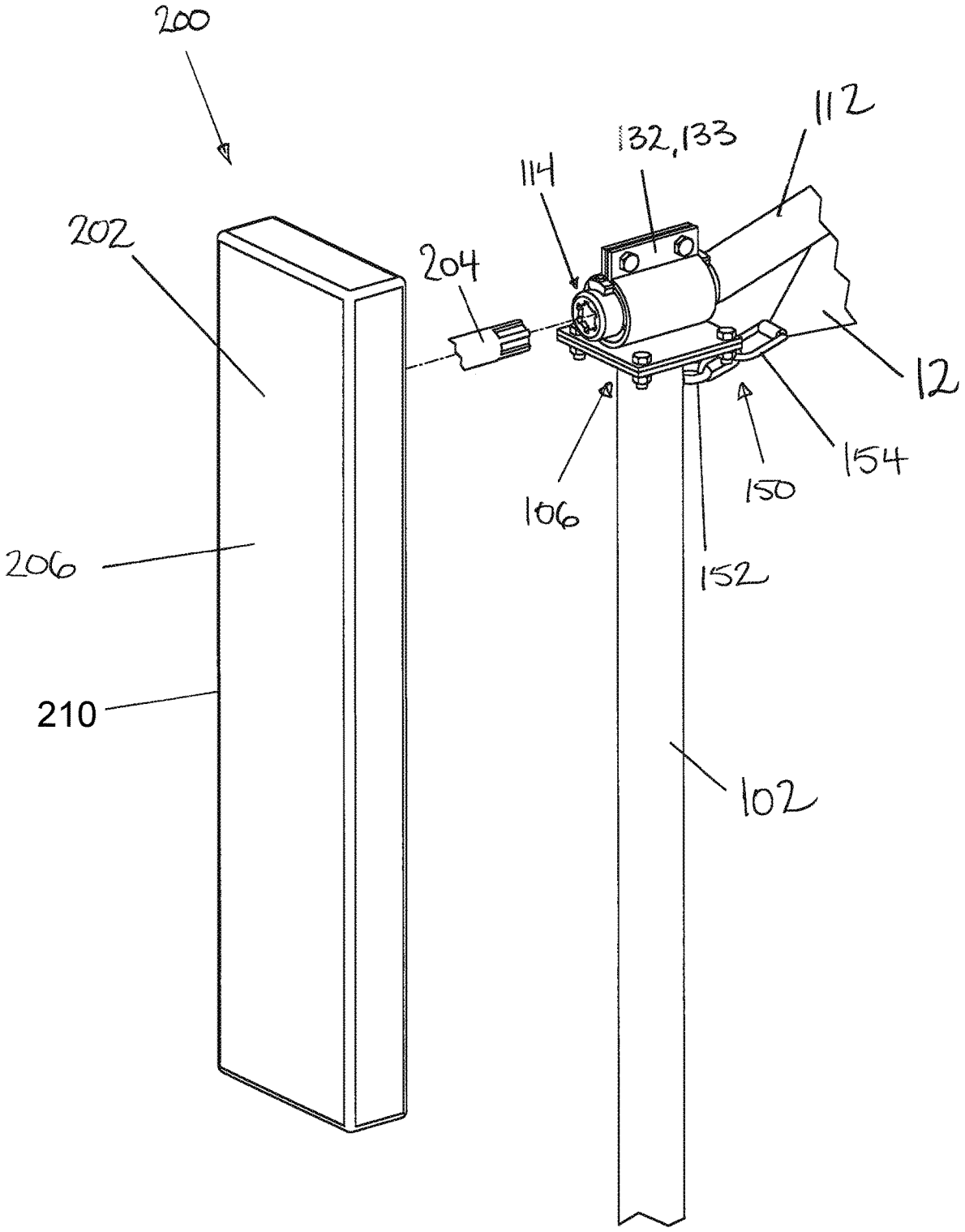
FIG. 5 is a partially exploded perspective view of an inclination adjustment mechanism, showing a rod engagement member adapted to engage a frame member in rotation according to an embodiment.
Figure 6C:
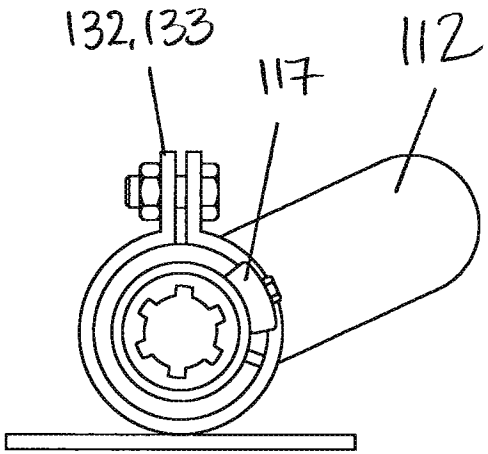
FIG. 6A to 6C are front elevation views of the coupling assembly shown in FIG. 2B, showing various angular positions of the frame member within the coupling assembly, according to some embodiments.
Figure 6B:
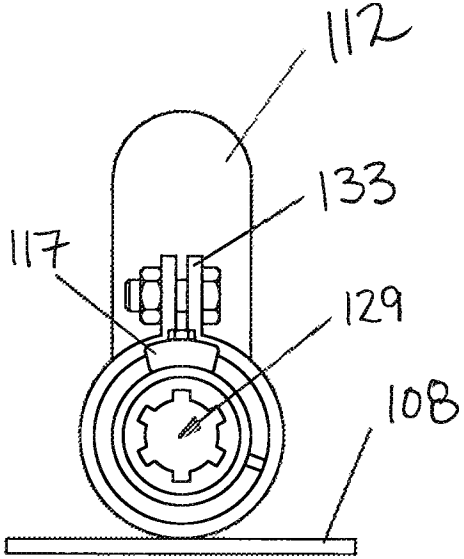
Figure 6A:
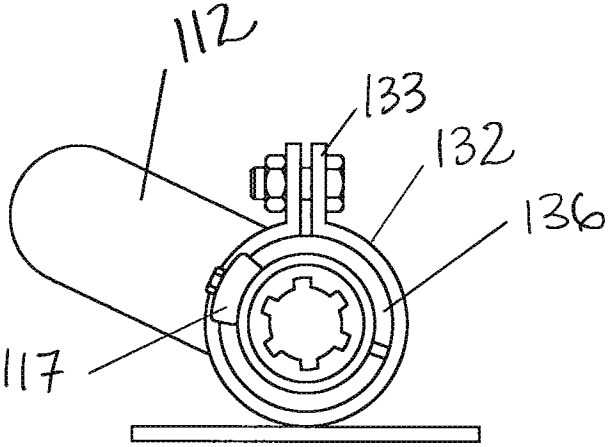

Referring more specifically to FIG. 5, in addition to FIG. 2B, an exemplary embodiment of the inclination adjustment mechanism 200 is shown. As previously mentioned, the inclination adjustment mechanism 200 includes a motor 202 operatively connected to one of the frame members for engaging same in rotation/pivoting/tilting. In the present embodiment, the motor 202 is connected to the first frame member 112, and more specifically to the end portion 114 thereof, in a manner such that operation of the motor 202 effectively engages the frame member 112 in rotation/pivoting/tilting. The inclination adjustment mechanism 200 further includes a rod engagement member 204 extending from the motor 202 shaped and configured to operatively connect the motor 202 to the end portion 114 of the first frame member 112. As seen in FIG. 2B, the end portion 114 includes a distal surface 128 provided with a recess 129 shaped and sized to receive the engagement member 204 therein, thereby connecting the frame member 112 with the motor 202. In an embodiment, the engagement member 204 is complementarily shaped with respect to the recess 129 such that rotation of the engagement member 204 effectively engages the frame member 112 in rotation. In the embodiment shown, the rod engagement member 204 is a male member and the end portion 114 includes a female member, i.e. a recess, complementary in shape with the male member. However, it is appreciated that, in an alternative embodiment (not shown), the rod engagement member 204 could be a female member into which a complementary male member, provided at the end portion 114, could be engaged, i.e. inserted.

In this embodiment, the inclination adjustment mechanism 200 includes a single motor 202, as a frame actuator, with a single engagement member 204 configured to engage one of the end portions 114 of the first frame member 112. As such, it is understood that the second end portion 114 (seen in FIG. 2A) is not provided with a recess adapted to receive a corresponding engagement member. However, it is appreciated that the sunshade 10 can alternatively include two inclination adjustment mechanisms 200 connected at opposite ends of the first frame member 112 for facilitating rotation thereof through engagement of each end portion 114 in rotation.

It is appreciated that, in the embodiment shown, no relative rotation is allowed between the end portion 114 of the first frame member 112 and the rod engagement member 204. In the embodiment shown, to prevent relative rotation therebetween, the rod engagement member 204 comprises a plurality of outwardly protruding and peripherally positioned teeth and the recess 129 defined in the distal end 128 of the end portion 114 includes complementary indentations. It is appreciated that the shape, configuration, and number of complementary teeth/indentations can vary from the embodiment shown.

With reference to FIGS. 6A to 7B, the adjustment mechanism 200 can be configured to rotate/pivot/tilt the canopy 12 in either direction. From a starting position (FIGS. 6B and 7B), corresponding to a substantially horizontal position of the canopy 12, the inclination adjustment mechanism 200 can rotate the frame member 112 (and thus the canopy 12) between about 1 degree and about 90 degrees in either direction (i.e., clockwise and counterclockwise). In an embodiment, the inclination adjustment mechanism 200 can rotate the canopy 12 between about 1 and 55 degrees in either direction, corresponding to the position of the frame member 112 shown in FIGS. 6A and 6C, which corresponds to the canopy 12 position shown in FIGS. 7A and 7C. However, it is appreciated that the canopy 12 can be rotated via the inclination adjustment mechanism 200 to any suitable angular position.

Referring back to FIG. 5, the inclination adjustment mechanism 200 can include a controller 206 operatively connected to the motor 202 for controlling same. The controller 206 can be operated via a control panel (not shown) positioned proximate the motor 202 and/or controller 206, or remotely via remote control. Alternatively, the inclination adjustment mechanism 200 can be adapted to be manually operated. For example, the engagement member 204 can be operatively connected to a crank (not shown), or any other suitable/similar frame actuator, adapted to be manually operated for engaging the frame member 112 in rotation, and adjusting the angular position of the canopy 12. It is appreciated that the inclination adjustment mechanism 200 can include both the controller 206, and the crank, such that the canopy 12 can be adjusted both remotely and/or manually.

In some embodiments, the components of the inclination adjustment mechanism 200 (e.g., motor 202, controller 206, etc.) can be contained within a housing 210 connectable to the support structure 100. It will be understood that the aforementioned control panel can be provided on a surface of the housing 210 for convenience, although it is appreciated that other configurations are possible. Furthermore, the various components of the inclination adjustment mechanism 200 (e.g., motor 202, controller 206, control panel) can be solar-powered, and can therefore not require electrical wires to provide power. In some embodiments, a solar cell, or solar panel (not shown), can be positioned on the housing 210 and operatively connected to the aforementioned components to provide power thereto. However, it is appreciated that other configurations are possible.

In another exemplary embodiment, the sunshade 10 can be automatically operated. For example, the inclination adjustment mechanism 200 can include one or more solar panels (not shown) adapted to provide power to the motor 202. The solar panels can be positioned on the central hub 120, or along the frame members 112, 118, and configured to follow the position of the sun throughout the day. Therefore, the canopy 12 will rotate along with the movement of the sun across the sky in a manner such that the sun remains opposite a top surface of the canopy 12.

It will be appreciated from the foregoing disclosure that the sunshade, and corresponding inclination adjustment mechanism, described above can be operable to facilitate the angular adjustment of a canopy with minimal interactions and/or manipulation thereof. Advantageously, the inclination adjustment mechanism allows for relatively easy adjustment of large canopies which can otherwise be over encumbering due to their size and/or weight.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A sunshade comprising:

a canopy support structure for supporting a canopy, comprising:

at least two support rods, each one of the support rods having a length axially extending between a base and a top end;

coupling assemblies, each one of the coupling assemblies being connected to the top end of a respective one of the support rods; and a canopy frame comprising a frame member having opposed end portions pivotally connected to a corresponding one of the coupling assemblies, the canopy being supported at least partially by the canopy frame; and an inclination adjustment mechanism for adjusting an angle of the canopy, comprising:

a frame actuator mounted to the support structure and comprising a motor; and a rod engagement member operatively connecting the frame actuator to the frame member, whereby operation of the frame actuator pivots the frame member via the rod engagement member, thereby tilting the canopy frame.

2. The sunshade according to claim 1, wherein the end portions of the frame member are axially aligned with one another.

3. The sunshade according to claim 1, wherein each one of the coupling assemblies comprises a coupling housing fixedly connected to the top end of the respective one of the support rods, the coupling housing having a passage defined therethrough for receiving the corresponding one of the end portions of the frame member, and wherein each one of the end portions is axially aligned with the passage of the corresponding one of the coupling housings.

4. The sunshade according to claim 3, wherein each one of the coupling housings includes a clamp selectively adjustable to vary a surface area of the passage and facilitate engagement of the corresponding one of the end portions within the passage, and wherein each one of the coupling assemblies further comprises a bushing mounted to the corresponding one of the end portions, the bushings being shaped and configured to allow rotation of the corresponding one of the end portions within the passage and at least partially prevent radial movement of the end portions when engaged within the passages.

5. The sunshade according to claim 3, wherein each one of the end portions of the frame member comprises a proximal protrusion extending radially and outwardly from a proximal section thereof for abutting against a first lateral side of the coupling housing upon engagement of the end portion within the passage of the coupling housing.

6. The sunshade according to claim 5, wherein each one of the end portions further comprises a distal protrusion removably connectable to a distal section thereof, the distal protrusion abutting against a second lateral side of the coupling housing when the end portion is engaged within the passage and the distal protrusion is secured to the distal section of the end portion, thereby positioning the coupling housing between the proximal and distal protrusions.

7. The sunshade according to claim 1, wherein the inclination adjustment mechanism further comprises a controller operatively connected to the motor to control same, the controller being remotely controllable.

8. The sunshade according to claim 1, wherein one of the end portions of the frame member comprises an end surface having a recess defined therein, and wherein the rod engagement member is insertable into the recess with relative rotation between the rod engagement member and one of the end portions being substantially prevented when engaged together, thereby engaging the frame member in rotation upon operation of the frame actuator.

9. The sunshade according to claim 8, wherein the rod engagement member comprises at least one outwardly protruding and peripherally positioned tooth and the recess defined in the distal end of the one of the end portions includes at least one complementary indentation, with the at least one tooth being insertable into the at least one complementary indentation to substantially prevent relative rotation between the rod engagement member and the one of the end portions.

10. A sunshade comprising:

a canopy support structure for supporting a canopy above a ground surface, comprising:

coupling assembly supports;

coupling assemblies, each one being mounted to a respective one of the coupling assembly supports; and a canopy frame comprising a frame member having opposed end portions pivotally connected to a corresponding one of the coupling assemblies, at least one end portion being provided with a recess, with the canopy being supported at least partially by the canopy frame; and an inclination adjustment mechanism adapted to adjust an angle of the canopy, the inclination adjustment mechanism comprising a motor mounted to the support structure and a rod engagement member insertable into and complementarily shaped relative to the recess, the rod engagement member being adapted to operatively connect the motor to the frame member, whereby rotation of the engagement member via the motor engages the frame member in rotation where operation of the motor engages the rod engagement member in rotation, where relative rotation between the rod engagement member and the at least one end portion is at least partially blocked when the rod engagement member engages the recess.

11. The sunshade according to claim 10, wherein the inclination adjustment mechanism further comprises a frame actuator operatively connected to the rod engagement member whereby actuation of the frame actuator engages the rod engagement member and the frame member in rotation simultaneously.

12. The sunshade according to claim 11, wherein the frame actuator of the inclination adjustment mechanism comprises of a crank engageable with the rod engagement member to engage same in rotation.

13. The sunshade according to claim 11, wherein the end portions of the frame member are axially aligned with one another, and wherein each one of the coupling assemblies comprises a coupling housing fixedly connected to the respective one of the coupling assembly supports, the coupling housing having a passage defined therethrough for receiving the corresponding one of the end portions of the frame member.

14. The sunshade according to claim 13, wherein each one of the coupling housings includes a clamp selectively adjustable to vary a surface area of the passage and facilitate engagement of the corresponding one of the end portions within the passage, and wherein each one of the coupling assemblies further comprises a bushing mounted to the corresponding one of the end portions, the bushings being shaped and configured to allow rotation of the corresponding one of the end portions within the passage and at least partially prevent radial movement of the end portions when engaged within the passages.

15. The sunshade according to claim 13, wherein each one of the end portions of the frame member comprises a proximal protrusion extending radially and outwardly from a proximal section thereof for abutting against a first lateral side of the coupling housing upon engagement of the end portion within the passage of the coupling housing.

16. The sunshade according to claim 15, wherein each one of the end portions further comprises a distal protrusion removably connectable to a distal section thereof, the distal protrusion abutting against a second lateral side of the coupling housing when the end portion is engaged within the passage and the distal protrusion is secured to the distal section of the end portion, thereby positioning the coupling housing between the proximal and distal protrusions.

17. The sunshade according to claim 10, wherein the rod engagement member comprises at least one outwardly protruding and peripherally positioned tooth and the recess defined in the distal end of the one of the end portions includes at least one complementary indentation, with the at least one tooth being insertable into the at least one complementary indentation to substantially prevent relative rotation between the rod engagement member and the one of the end portions.

* * * * *